US005624256A

United States Patent [19]

Pfeiffer et al.

[11] Patent Number: 5,624,256

[45] Date of Patent: Apr. 29, 1997

[54] CERAMIC LINING FOR COMBUSTION CHAMBERS

[75] Inventors: Andreas Pfeiffer, Lauchringen, Germany; Hugo Wetter, Buchs, Switzerland

[73] Assignee: ABB Management AG, Baden, Switzerland

[21] Appl. No.: 586,159

[22] Filed: Jan. 17, 1996

[30] Foreign Application Priority Data

Jan. 28, 1995 [DE] Germany ..... 195 02 730.2

[51] Int. Cl.[6] ..... F27D 1/14

[52] U.S. Cl. ..... 432/252; 110/336; 110/338; 52/506.02

[58] Field of Search ..... 432/248, 249, 432/252; 110/323, 336, 338, 339, 340; 52/265, 268, 269, 506.02, 506.03, 506.04, 784.11, 784.15, 794.1

[56] References Cited

U.S. PATENT DOCUMENTS 4,139,975 2/1979 Baker ..... 52/506.02

4,157,001 6/1979 Pickles ..... 52/506.02

FOREIGN PATENT DOCUMENTS 3803681 12/1988 Germany ..... 52/506.02

*Primary Examiner*—Noah P. Kamen

*Attorney, Agent, or Firm*—Burns, Doane, Swecker & Mathis, L.L.P.

[57] ABSTRACT

In the case of a ceramic lining for combustion spaces, comprising at least one wall panel (3) of high temperature resistant structural ceramic with at least one through-opening (6) and comprising one fastening element (4) per opening (6), the fastening element (4) being fastened by its foot in a metallic holding device (5) fastened on the metallic supporting wall (1), and the head of the fastening element (4) resting in the opening (6) of the wall panel (3), and there being an insulating layer (2) arranged between the metallic supporting wall (1) and the ceramic wall panel (3), the fastening element (4) consists of high temperature resistant structural ceramic. The wall panel (3) is drawn-in in the direction of the metallic supporting wall (1) in the region of the opening (6) and the fastening element (4) is resiliently linked to a special holding device (5).

10 Claims, 3 Drawing Sheets

CERAMIC LINING FOR COMBUSTION CHAMBERS

BACKGROUND OF THE INVENTION

1. Field of the Invention

The invention relates to a ceramic lining for walls of combustion spaces subjected to high temperatures, in particular combustion chambers for gas turbines, the lining comprising individual elements which are fastened on the metallic wall by means of holding devices.

2. Discussion of Background

The use of ceramic materials for the lining of combustion spaces subjected to high temperatures is known.

Lining with refractory elements based on oxidic materials may be regarded as prior art. Apart from the low mechanical stability and the thick-walled, heavy construction, these linings have the disadvantage that the individual elements cannot be removed non-destructively. In addition, the oxidic materials used for these linings are not capable in terms of material properties of withstanding the ever increasing mechanical and thermal loads, for example in gas turbine combustion chambers.

A structure which is similar in principle, comprising interlocking individual elements without a solid connection of the individual parts, such as is described for example in DE 2 854 580, is likewise unsuitable for use in heavy-duty industrial combustion chambers.

Releasable connections of ceramic individual elements are almost always based on the use of cooled metallic holding devices (for example U.S. Pat. No. 2,548,485), which at least partly counteract a major advantage of the concept—that of creating a quasi adiabatic combustion space.

In EP 080 444 B2 it is proposed for a cast refractory lining of a furnace to sinter the anchoring irons into a refractory composition. This then forms with the anchoring irons anchoring elements, which are fastened on the furnace wall by bolts. This has the disadvantage that the mechanical properties of the component are impaired by the inhomogeneities within the ceramic structural element.

For combustion spaces of small dimensions, there are known types of design for constructing the wall of the combustion space from annular elements which, apart from axial fixing, only have to be centered. However, for technical manufacturing and production-related reasons, this concept cannot be used for larger combustion spaces.

The currently available high temperature resistant structural ceramics, such as for example silicon carbide SiC and silicon nitride $Si_3N_4$, are not suitable as a lining for use in industrial combustion chambers which comprises an interlocking structure of individual elements without a solid connection of the parts.

SUMMARY OF THE INVENTION

Accordingly, one object of the invention, which attempts to avoid all these disadvantages, is to provide a novel uncooled detachable lining of a combustion space with ceramic elements which withstands the high mechanical and thermal stresses in a commercial heavy-duty combustion chamber.

This is achieved according to the invention by providing that, in the case of a ceramic lining for combustion spaces, comprising at least one wall panel of high temperature resistant structural ceramic with at least one through-opening and comprising one fastening element per opening, the fastening element being fastened by its foot in a metallic holding device fastened on the metallic supporting wall, and the head of the fastening element resting in the opening of the wall panel, and there being an insulating layer arranged between the metallic wall and the ceramic wall panel, the fastening element consists of high temperature resistant structural ceramic and is resiliently linked to the holding device.

To be regarded as among the advantages of the invention are that the lining is able to withstand very high mechanical and thermal stresses on account of its homogeneity and the material used, that the lining can be removed non-destructively and therefore can be used repeatedly and that, due to the resilient linking of the ceramic structure to the metallic holding construction, the thermal expansions between metallic and ceramic components or deformations of the insulating layer caused by mechanical stresses are absorbed.

It is particularly expedient if the fastening element has a form which is optimized from heat engineering aspects, preferably a concave depression in the center of the head, a rounded-off head and rounded-off cross-sectional transitions with large radii from the head to the shank and from the shank to the foot. This achieves the effect that the mechanically and thermally dependent loads cause only low stresses.

It is of advantage if the shank of the fastening element is surrounded by a divided sleeve of hardened, preformed insulating material and the contact surfaces with respect to the metal in the region of the foot of the fastening element are also provided with an insulating layer. This leads to a minimization of the temperature gradient within the ceramic fastening element, so that the thermal stresses can be kept at a low level.

Furthermore, it is advantageous from heat engineering aspects if, in the region of the opening, the wall panel is drawn-in in the direction of the metallic supporting wall, so that the head of the fastening element is received fully by the opening in the ceramic wall panel.

Furthermore, it is advantageous if the insulating layer consists of ceramic fibrous material which can be applied in the form of prefabricated blocks.

Finally, if using at least two wall panels, the insulating layer is advantageously hardened or otherwise protected at the surface, at least in the region of the joint of the neighboring wall panels. As a result, if there are parasitic hot air flows in the gap, flushing out of the insulation is avoided. In addition, the insulating layer has a bore in the region of the fastening element to be received.

It is expedient if the metallic holding device comprises a longitudinally divided threaded sleeve which embraces the foot of the fastening element, having a nut seated on the external thread of the sleeve, and having a guide ring recessed into the metallic wall, a guide sleeve and spring elements. This achieves a connection between the foot of the ceramic fastening element and the metallic parts which is reliable, releasable and can be adjusted well by means of the threaded nut.

Finally, a seal is advantageously arranged between the guide sleeve and the guide ring. This seal prevents possible leakage air flows, which could occur on account of the generally positive pressure gradient between the outer side of the lining, on the cooling air side, and the inner side of the lining, on the hot gas side.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Only the elements essential for an understanding of the invention are shown.

DESCRIPTION OF THE PREFERRED EMBODIMENTS

Figure 1:
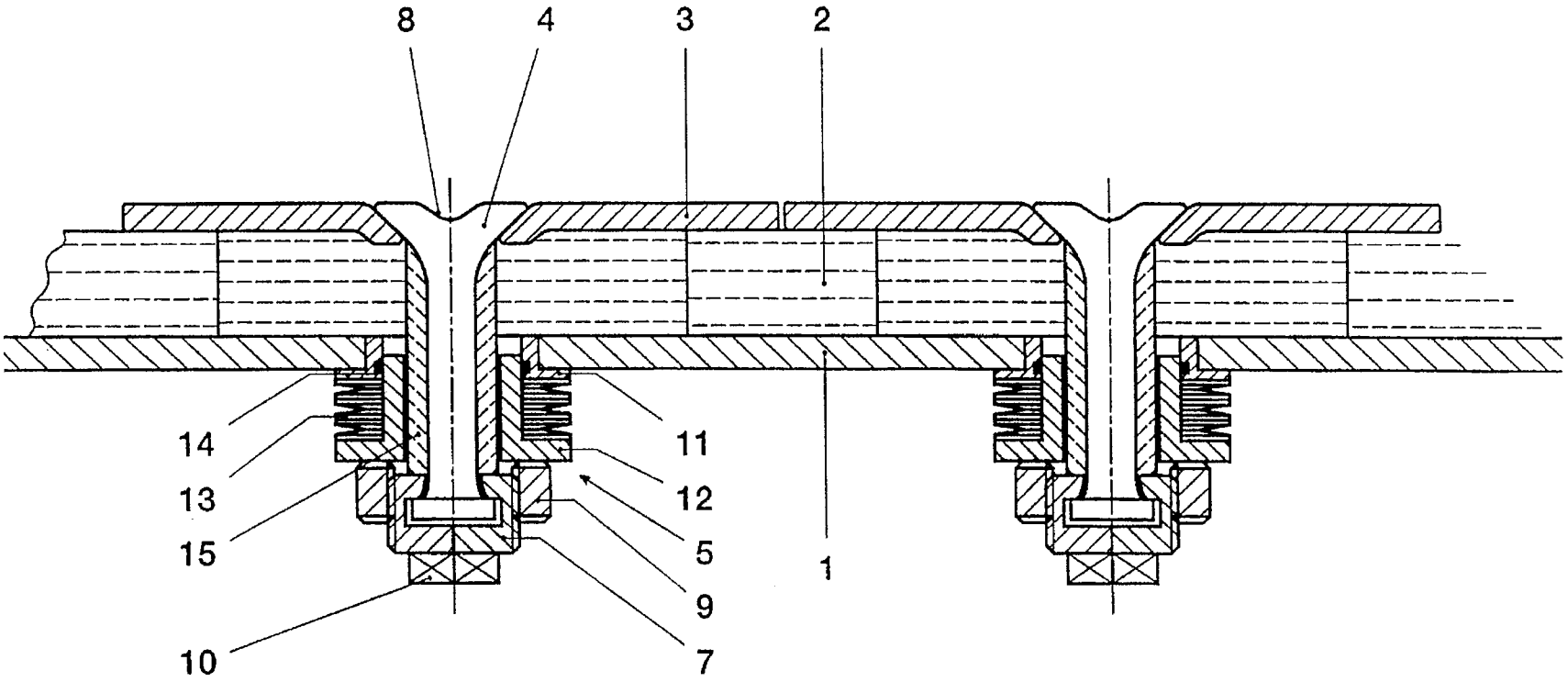
FIG. 1 shows a partial longitudinal section of the lining for a gas turbine combustion chamber.

Referring now to the drawings, wherein like reference numerals designate identical or corresponding parts throughout the several views, in FIG. 1 there is shown a partial longitudinal section of the lining according to the invention for a gas turbine combustion chamber. An insulating layer 2 has been applied to the metallic supporting wall 1 of the combustion chamber. This insulating layer preferably consists of ceramic fibrous material. Arranged in turn on the insulating layer are ceramic wall panels 3, which consist of high temperature resistant structural ceramic, for example SiC or $Si_3N_4$. The wall panels 3 and the insulating layer 2 are fastened on the metallic supporting wall 1 with the aid of fastening elements 4, which are respectively arranged in a metallic holding device 5, which is described in detail later. Like the wall panels 3, these fastening elements 4 likewise consist of high temperature resistant structural ceramic.

The outer form and the dimensions of the wall panels 3 can be adapted without any problem to the geometry of the space to be lined and are not predetermined in any way.

Figure 2:
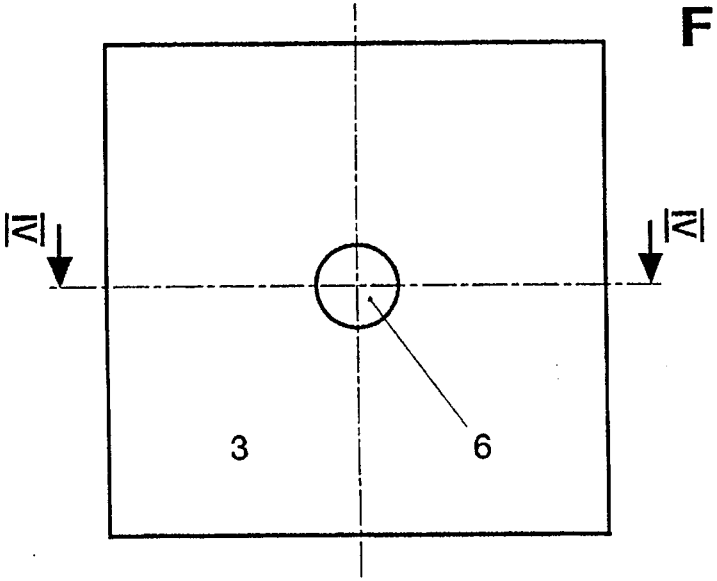
FIG. 2 shows a plan view of the lining when using square wall panels.

FIG. 2 shows that, in the simplest case, this may be a square contour, in order to line planar or only slightly curved combustion spaces. Similarly, wall panels 3 having a rectangular outer contour can also be used.

Figure 3:
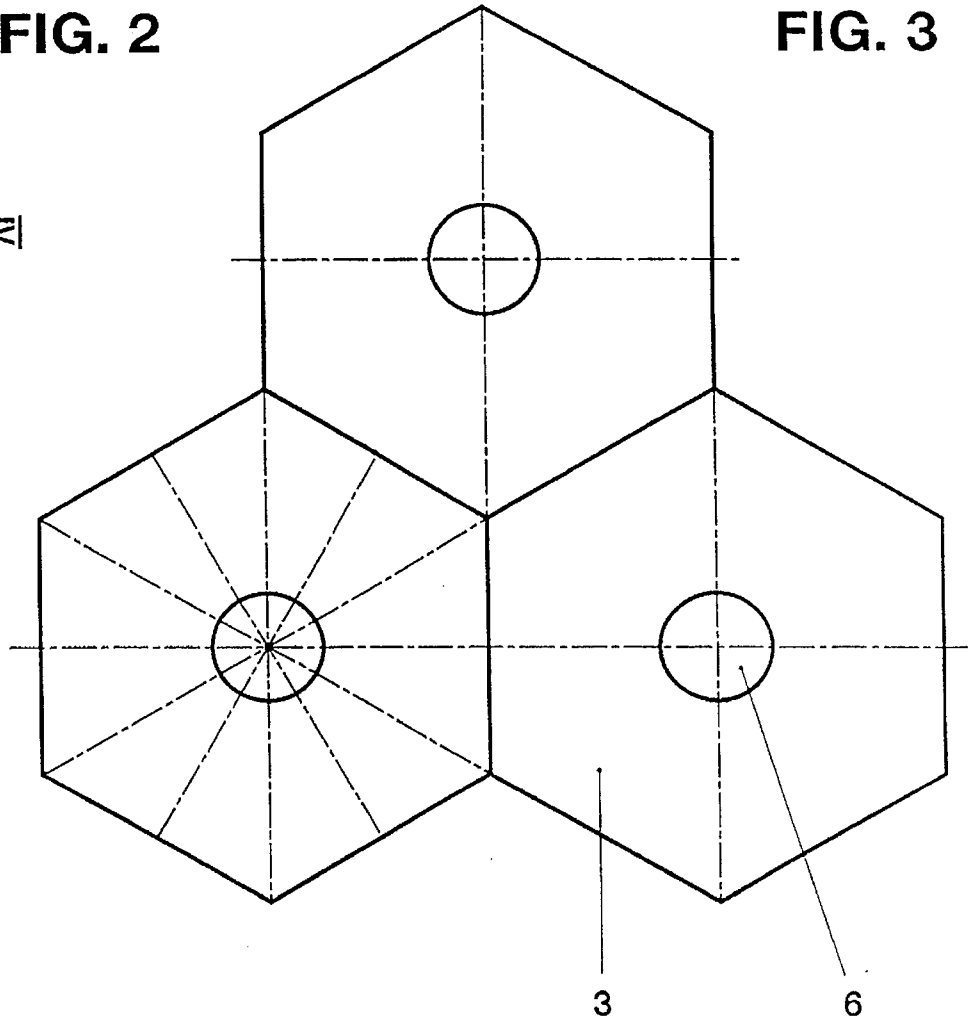
FIG. 3 shows a plan view of the lining when using hexagonal ceramic wall panels.

FIG. 3 reveals a further possible form of the wall panels 3. In this design variant, they have a hexagonal outer contour. For reasons of simple manufacture and a uniform stress distribution under thermal and mechanical stress, symmetrical forms are to be preferred. The thickness d of the wall panel 3 results on the one hand from the required mechanical stability and on the other hand from a minimization of the thermal stresses on account of the temperature gradients in the component.

Arranged in the center of the wall panel 3 is a through-opening 6 for receiving a fastening element 4, which in this case is a bolt which comprises head, shank and foot. It goes without saying that in other exemplary embodiments, not shown here, there may also be a plurality of openings 6 in each wall panel 3.

Figure 4:
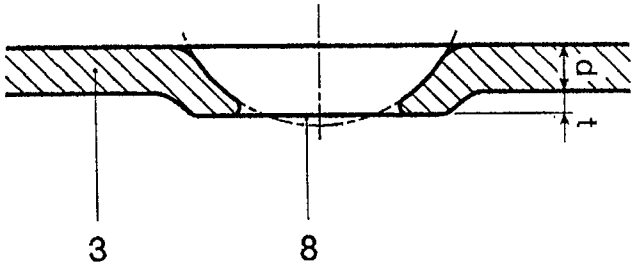
FIG. 4 shows an enlarged section of the wall panel in the region of the opening along the line IV—IV in FIG. 2.

As revealed by FIG. 4, which shows an enlarged section of the wall panel 3 according to FIG. 2 in the region of the opening 6 along the line IV—IV, the opening 6 is drawn-in in the direction of the metallic supporting wall 1. As a result, on the one hand the contact surface between the fastening element 4 and the wall panel 3 is enlarged, on the other hand the heat flows in the case of steady-state and non-steady-state stress gradients are influenced in such a way that only minimal thermal stresses occur. The geometrical shaping of this zone results from a matching of the heat retention and heat conduction properties of the materials used. A ratio of the thickness d of the wall panel 3 to the depth t of the drawn-in part of the wall panel 3 in the region of the opening 6 of about 5 to 3 has proved to be advantageous.

The contact surface between the head of the fastening element 4 (not shown in FIG. 4), arranged in the opening 6, and the wall panel 3 is optimally made spherical, in order to ensure surface area contact even in the case of positions of the bolt at acute angles (ball head principle). This means that the head of the fastening element 4 is also made spherical, which can be seen well in FIGS. 5*a* and 5*b*, which respectively show a longitudinal section of two differently designed fastening elements 4.

Figure 5B:
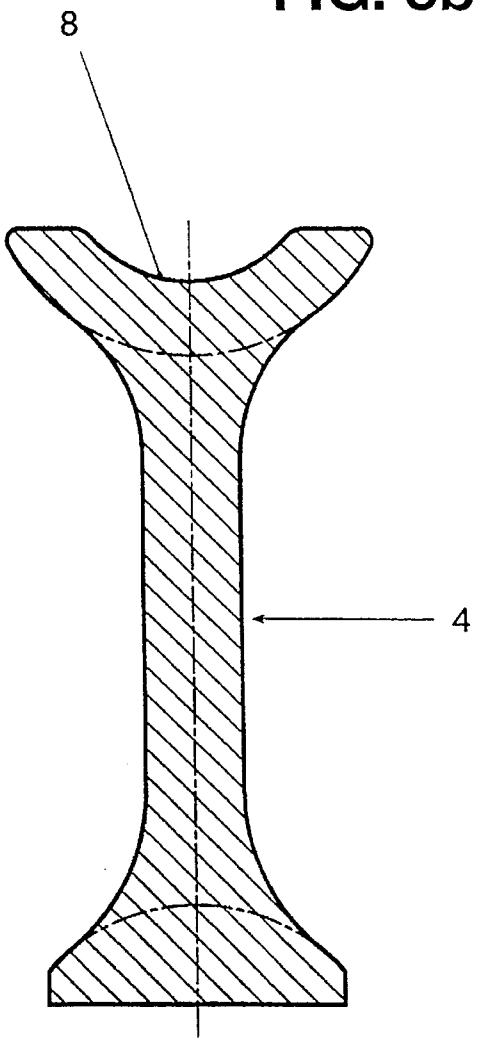
FIGS. 5*a,b* each show a longitudinal section of the fastening element.
Figure 5A:
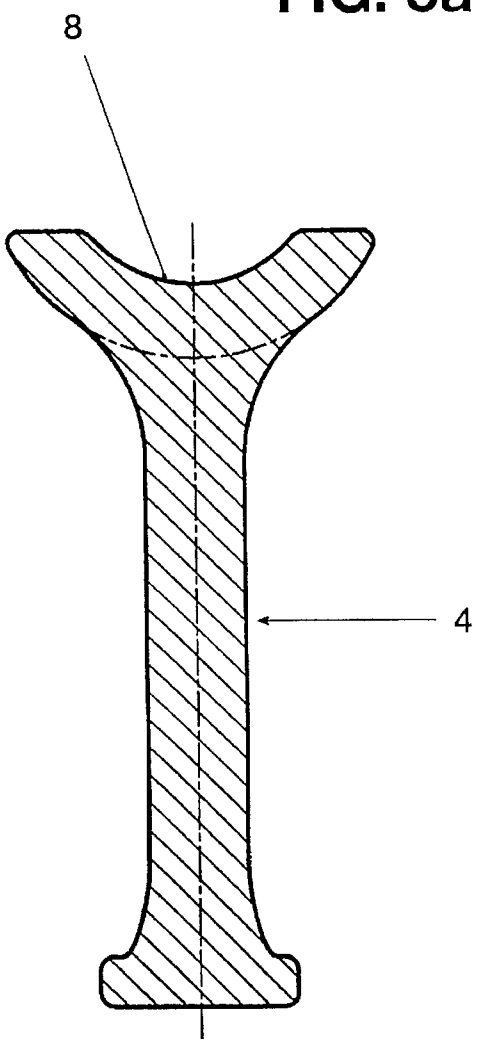

In the case of the fastening element 4 represented by way of example in FIG. 5*b*, the foot of the fastening element 4 is also spherically designed, which is then received by a correspondingly designed threaded sleeve 7 of the metallic holding device 5. Since the metal/ceramic contact surface on the foot of the fastening element 4 is thus also spherically designed, surface area contact even in positions at acute angles is likewise ensured here.

A further special feature of the fastening element 4 optimized from heat engineering aspects is that the head of the fastening element 4 has in its center a concave depression 8. In addition, large radii and moderate cross-sectional transitions are used, so that basic rules for designing with brittle ceramic materials are observed.

The cavity between the shank of the fastening element 4 and the insulating layer 2 is filled by a divided sleeve 15 of hardened, preformed insulating material. Since the contact surfaces with respect to the metal in the region of the foot of the fastening element 4 are also provided with an insulating intermediate layer, as a result the temperature gradients within the fastening element 4 are minimized and the thermal stresses are kept at a low level.

The thickness of the insulating layer 2 is chosen according to the thermal loading of the overall composite structure of the lining. It is to be set such that the maximum permissible temperatures of the metallic supporting wall 1 are not exceeded. The insulating material may be applied, for example, in the form of prefabricated blocks, there having to be present in the region of the fastening bolt 4 a corresponding bore for the mounting of the lining. Since the mounting clearance between two wall panels 3 is determined by the thermal expansions of the wall panels 3, the insulating material is hardened or otherwise protected in a suitable way on its surface, at least in the region underneath the joints of two neighboring panel elements, so that, if there are parasitic hot air flows in the gap, flushing out of the insulating layer 2 is avoided.

A central point of the invention is the expansion-tolerant resilient restraint of the ceramic fastening element 4 on the outer side of the metallic supporting wall 1.

According to FIG. 1, the metallic holding device 5 comprises a longitudinally divided threaded sleeve 7, which embraces the foot of the fastening element. Arranged on the external thread of the threaded sleeve 7 is a threaded nut 9, by means of which the restraining force can be adjusted, as explained further below. At the same time, the nut 9 holds together the two halves of the threaded sleeve 7. The mutual positioning of the two threaded sleeve halves can be secured by additional design elements, for example the bolts. A square end 10 serves the purpose of holding the divided sleeve when tightening the threaded nut 9. Items 7 and 10 are part of the divided sleeve.

Furthermore, the metallic holding device 5 comprises a guide ring 11 recessed into the metallic supporting wall 1, a one-part guide sleeve 12 for the fastening element 4 and spring elements 13 arranged between the guide sleeve 12 and the guide ring 11. The spring 13 is, for example, as shown in FIG. 1, a cup spring. The resilient linking of the ceramic structure to the metallic holding device achieves the effect that relative thermal expansions between the metallic and ceramic components or deformations of the insulating layer 2 ("settling") caused by mechanical stresses, for example pulsations in the combustion space, are absorbed without impermissibly high stresses being induced in the ceramic component on the contact surfaces. By means of a specific spring excursion of the restraint (which can be adjusted by means of the threaded nut 9 screwed onto the external thread of the sleeve 7), virtually constant restraining forces are ensured.

Since there is generally a positive pressure gradient between the outer side of the lining, on the cooling air side, and the inner side of the lining, on the hot gas side, there is arranged a seal 14 against possible leakage air flows. This seal 14 is located between the guide sleeve 12 and the guide ring 11 recessed in the metallic supporting wall 1. The backlash in the guide in this case also allows a certain angular position of the bolt without additional forces being introduced into the bolt.

By use of the holding device 5 in connection with the ceramic fastening elements 4, non-destructive removal of the ceramic lining, and consequently repeated use of the ceramic elements, is made possible.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A ceramic lining for a combustion space, the combustion space having a supporting wall, comprising:

at least one wall panel of high temperature resistant structural ceramic, the wall panel having at least one through-opening;

one or more fastening elements corresponding in number to the at least one opening, each fastening element having a foot and a head and consisting of a high temperature resistant structural ceramic;

one or more holding devices corresponding in number to the at least one opening, each holding device being fastened on the supporting wall, each fastening element being arranged with its foot in a corresponding one of the holding devices such that each fastening element is resiliently linked to the corresponding holding device;

the head of each fastening element being disposed in a corresponding opening; and an insulating layer arranged between the supporting wall and the ceramic wall panel.

2. The ceramic lining as claimed in claim 1, wherein each fastening element has a concave depression in a center of its head and rounded-off cross-sectional transitions between the head and a shank of the fastening element and between the shank and the foot.

3. The ceramic lining as claimed in claim 1, wherein each fastening element includes a shank, the ceramic lining further including one or more divided sleeves of hardened preformed insulating material, the one or more divided sleeves corresponding in number to the one or more fastening elements and each divided sleeve surrounding a shank of a corresponding fastening element.

4. The ceramic lining as claimed in claim 1, wherein, in a region of the opening, the wall panel is drawn-in toward the supporting wall.

5. The ceramic lining as claimed in claim 1, wherein the insulating layer consists of ceramic fibrous material.

6. The ceramic lining as claimed in claim 5, comprising at least two neighboring wall panels defining a joint between the wall panels, wherein the insulating layer is hardened, at least in a region of the joint.

7. The ceramic lining as claimed in claim 5, wherein the insulating layer includes one or more bores corresponding in number to the one or more fastening elements, the one or more bores each being located in a region through which a corresponding one of the fastening elements is received.

8. The ceramic lining as claimed in claim 1, wherein the holding device includes one or more longitudinally divided threaded sleeves corresponding in number to the one or more fastening elements, each threaded sleeve embracing a foot of a corresponding fastening element, the holding device including a threaded nut seated on an external thread of the sleeve, a guide ring recessed into the metallic supporting wall, a guide sleeve through which a corresponding one of the one or more fastening elements extends, and spring elements arranged between the guide sleeve and the guide ring.

9. The ceramic lining as claimed in claim 8, wherein each fastening element further includes a seal arranged between the guide sleeve and the guide ring.

10. The ceramic lining as claimed in claim 1, wherein the holding device is metallic.

* * * * *